United States Patent [19]

Dietrich

[11] Patent Number: 4,499,345

[45] Date of Patent: Feb. 12, 1985

[54] MAGNETIC SNAP SWITCH

[75] Inventor: Bernhard Dietrich, Eichenau, Fed. Rep. of Germany

[73] Assignee: SDS-Elektro G.m.b.H., Deisenhofen, Fed. Rep. of Germany

[21] Appl. No.: 442,875

[22] Filed: Nov. 19, 1982

[30] Foreign Application Priority Data

Nov. 20, 1981 [DE] Fed. Rep. of Germany ..... 3146068

[51] Int. Cl.[3] ..... H01H 5/02

[52] U.S. Cl. ..... 200/67 F; 335/188

[58] Field of Search ..... 200/67 F, 67 R, 67 PK; 335/188, 207

[56] References Cited

U.S. PATENT DOCUMENTS

| | | | |
|---|---|---|---|
| 2,111,816 | 3/1938 | Shaw | 200/67 F |
| 2,337,001 | 12/1943 | Ray | 200/67 F |
| 2,385,887 | 10/1945 | Shaw | 200/67 F |
| 2,782,278 | 2/1957 | Peters | 200/67 F |
| 2,897,308 | 7/1959 | Fergus | 200/67 F |

*Primary Examiner*—Charles E. Phillips
*Assistant Examiner*—Ernest G. Cusick
*Attorney, Agent, or Firm*—Murray Schaffer

[57] ABSTRACT

A snap switch having an activating plunger which, when depressed, establishes an operative connection with a return spring, and causes the tensioning of a spring force accumulator. A ferromagnetic anchor is mounted pivotable about an axis running at right angles to the direction of the plunger. The anchor forms a jump member and is a component of a magnetic clamp arrangement containing a permanent magnet. The anchor activates at least one movable contact. The jumping action is initiated in both switching directions by the creation of an air gap between the anchor and its respective abutting surface in the magnet clamp. The magnetic clamp arrangement is formed by at least one yoke by way of which a magnetic circuit is closed in both positions of the anchor.

12 Claims, 4 Drawing Figures

MAGNETIC SNAP SWITCH

BACKGROUND OF THE INVENTION

The present invention relates to an electrical snap or quick-break switch comprising an activating plunger which, when depressed, establishes an operative connection with a return spring, and charges a spring force accumulator coupled to a ferromagnetic anchor. The anchor is mounted to be tiltable about an axis running at right angles to the direction of plunger activation. The anchor forms the jump member of a magnetic clamp arrangement having a permanent magnet and having two switching positions. The movement of the anchor activates at least one movable electric contact. An additional spring force accumulator is provided for the return and the jumping action is initiated in both switching directions by the generation of an air gap between the anchor and its respective abutting surface.

Quick-break switches having a jumping member which is activated merely by a spring have the disadvantage that the contact force in the immediate proximity of the jumping point becomes almost zero. This disadvantage does not occur with quick-break switches in which the jumping member is a component of a magnetic clamp arrangement. There is known, for instance, magnetic clamp arrangements with two permanent magnets firmly attached to the housing, and an adhesion plate (German examined patent spec. No. 1 118 315 and German printed publ. of unexamined patent spec. DE-OS No. 1 911 104); with a permanent magnet fixed to the housing and two adhesion plates (German patent spec. No. 24 45 957 and German printed publ. of unexamined patent specification No. 26 57 231) connected with the jumping member; as well as two adhesion plates fixed to the housing and a permanent magnet connected with the jumping member (German patent spec. No. 1 190 088). In all these known quick-break switches the jumping member executes a rectilinear displacement along the axis of the activating plunger, ergo in the direction of activation. Furthermore, the necessary springs, in particular the return and force accumulation springs are arranged in or at least along the same axis, so that these switches exhibit great structural length or depth.

Only the switch of the prior used type cited at the outset deviates in so far from this principle of construction. There, an anchor mounted tiltable about an axis running at right angles to the activating direction of the plunger is used, as a jumping member. This anchor is operatively connected with the plunger by way of an activating nose, and carries at each of its two ends a resilient electrical contact member. The anchor cooperates with a rod-shaped permanent magnet arranged in parallel to the activating plunger so as to abut with the magnet in each of the two switching positions and executes a tilting movement about a bearing supported in the center of the bar magnet for the purpose of changing the switching positions. Considerable flux leakage is generated in this design of the magnetic clamp arrangement. The attractive force of the permanent magnet is thus only inadequately utilized. A relatively large bar magnet is therefore necessary with a specified contact force. Since the pull-off force required for the separation of the anchor from the bar magnet is subjected to considerable spread between units, a relatively great activating force is required taking into account in addition the tolerances of the various springs still to be added.

An object of the present invention is to produce a quick-break switch of the type cited at the outset, which has a small structural size and requires a relatively small activating force.

SUMMARY OF THE INVENTION

The task noted above is solved pursuant to the invention by providing the magnetic clamp arrangement with a pair of yokes permanently magnetized and with which a magnetic circuit may be closed in two positions by movement of the anchor alternatively between the yokes.

In this way, flux leakage is prevented and the attractive forces of the permanent magnet are utilized optimally, making it possible to employ an especially small magnet, resulting not only in a small structural depth but overall in a switch of small size.

An especially preferred embodiment lies in the use of two sheet metal yokes of C-shape arranged parallel to each other, between which is arranged a permanent magnet and by constructing the ends of each of the sheet metal poles as pole shoes facing each other with the anchor situated between the latter.

The anchor can be mounted eccentrically within the area of one of its two ends so that it is tiltable into contact with the oppositely placed pole shoes.

It is suggested that the spaced opposed pole shoes assigned to the end of the anchor closest to the tilt axis be spaced at a lesser distance from each other than the pole shoes assigned to the free or more remote end of the anchor. In this way unnecessary air gaps in the area of one end of the mounted anchor are avoided and most of all, the anchor can also be mounted between the two pole shoes of the two sheet metal poles facing each other at a relatively short distance.

The longitudinal axis of the anchor can run in the latter's center position approximately at right angles to the direction of displacement of the activating plunger.

In order to obtain greater freedom in the arrangement of the activating plunger relative to the anchor, a rocker is arranged approximately coaxially to the latter and mounted tiltable about an axis running parallel to the rotational axis of the anchor. The rocker in turn is operatively connected with the activating plunger when the latter is depressed.

According to a further development of this embodiment, both the return spring, which is indispensible in any case, and one of the two necessary spring force accumulators can be accomodated in a space-saving manner by seating one arm of the rocker in a recess, having a free path of movement, formed in the activating plunger. The plunger furthermore is formed to contain a helical pressure spring which is part of the spring force accumulator. The pressure spring is loaded in the direction of activation of the plunger, so that the activating plunger bears against the return spring in direct non-positive connection.

The second spring force accumulator can also be accomodated in a space-saving manner by seating the other arm of the rocker in a recess, having a free path of movement, in an intermediate piece bearing or in non-positive connection with the anchor. The intermediate piece contains a helical pressure spring as part of the spring force accumulator, exerting pressure on the rocker in the opposite direction of the plunger activation.

The contacts are arranged expediently on the side of the anchor away from the rocker and the anchor activates the movable contact by way of a slide member. The slide member and the intermediate piece can preferably be combined so as to form a one-piece slide. In order to obtain in any case, i.e. also with welded contacts, a safe mandatory separation, it is recommended to have the slide coupled non-positively with the movable contact. The movable contact can be a simple contact leaf spring.

A more advantageous form of construction may be obtained by forming the movable contact of a resilient contact arm, one end of which is formed as a knife-edge contact resting constantly on a fixed contact, while the other end is designed in connection with an additional fixed contact as a break, make, or change-over contact. In this way, joining of the stationary end of the movable contact to the fixed contact assigned to this end is avoided.

Illustrated in the drawing is a quick-break switch pursuant to the invention is an embodiment selected by way of example.

DESCRIPTION OF THE INVENTION

Figure 1:
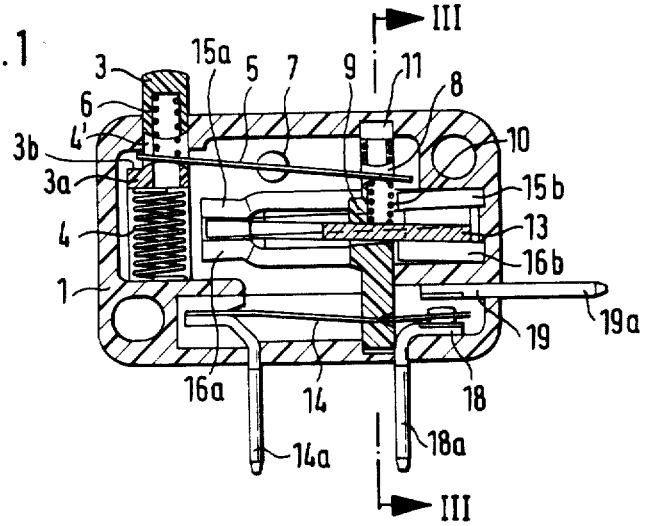
FIG. 1 is a side elevational view of the switch predominantly in section.
Figure 3:
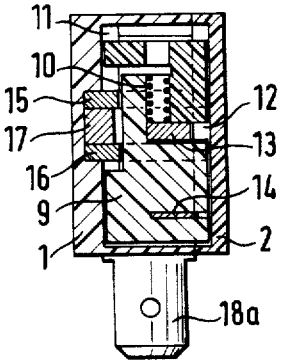
FIG. 3 is a cross-section of the switch along the line III—III of FIG. 1.
Figure 4:
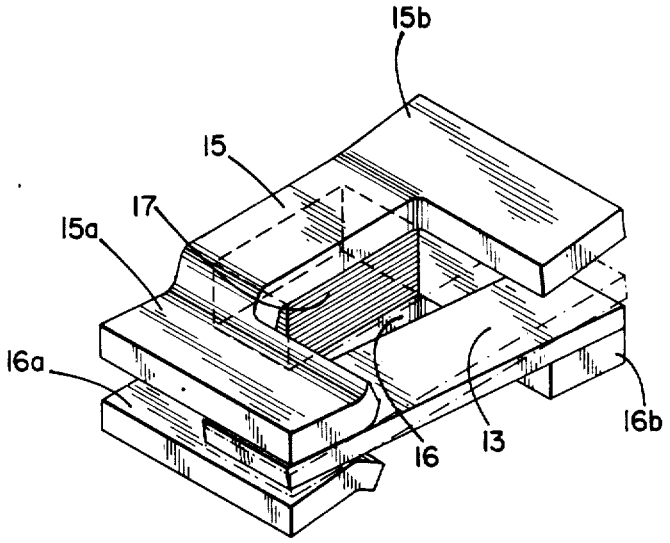
FIG. 4 is an enlarged view arrangement of the C-shape yokes and the permanent magnet.

The quick-break switch shown in FIGS. 1 and 3 comprises a housing formed of base 1 and a lid 2. A hollow activating plunger 3 extends through a wall of the housing with its lower inside end 3*a* resting directly on the upper end of a return spring 4. The lower end of the return spring 4 is braced securely against a shelf or inner wall of the housing.

The inside end 3*a* of the activating plunger 3 is provided with a stepped shoulder 3*b* and a recess 4', just above it. One end of a two-armed rocker 5 is held in the recess 4' with a certain free path and is biased against the shoulder 3*b* by a helical pressure spring 6, located in a bore in the activating plunger 3, forming a spring force accumulator. This end of the rocker 5 is loaded in the direction of movement of the activating plunger 3. The center of the rocker 5 pivots on a pivot 7 which is journalled in the side wall of the housing. The axis of the pivot 7 extend perpendicular to the axis of the plunger 3. The other end of the rocker 5 extends freely into a recess 8 formed in a plastic slide 9 which is movable in a direction parallel the plunger 3. This other arm of the rocker 5 is biased by a helical pressure spring 10, upwardly forming a second spring force accumulator, opposite in direction to that activation of the activating plunger 3.

The slide 9 extends practically over the entire height of the housing and is held in a guide groove 11 formed on the inside walls of the housing which permits it to move up and down a distance equal to the difference between its height and that of the housing. The slide 9 is provided along its side edge, approximately at its center with a keyway 12 (see FIG. 3) for a rod-shaped anchor 13. The bottom part of the slide 9 is furthermore provided with a slot through which a leaf spring contact arm 14 extends.

The anchor 13 consists of ferromagnetic material and is provided toward its left end (i.e. eccentric of its center line) with a bearing nose (not shown) which is journalled in a corresponding recess in the housing 1. The bearing nose has an axis extending normal to the axis of the plunger 3 and parallel to that of the pivot 7 of the rocker so that the anchor rocks similarily to that of the rocker 5.

The anchor 13 is the movable part of a magnetic circuit, the latter comprising in addition, two essentially parallel C-shaped sheet metal yokes 15, 16 (see FIG. 3), between the longitudinal webs of which is arranged a permanent magnet 17. The short legs of the sheet metal yokes 15 and 16 extending outward from the plane of the sheets of the drawing are designed as pole shoes 15*a*, 16*a* and 15*b*, 16*b*, respectively facing each other and which cooperate with the ends of the anchor 13 which lies between the respective poles. The long webs of the sheet metal poles 15 and 16 as well as the permanent magnet 17 are partially embedded in the housing 1 of the switch. The pole shoes 15*a* and 16*a*, located closest to the bearing nose of the anchor 13 are spaced at a substantially lesser distance from one another than the pole shoes 15*b* and 16*b* located at the opposite or free end of the anchor 13, so that the latter end of the anchor 13 is provided with sufficient play between the pole shoes 15*b* and 16*b*. The anchor 13 is thus freely movable between its pole shoes, and abuts flush, without an air gap, with each of the pole shoes 15*a* and 16*a* respectively when correspondingly moved. In the center position between the pole shoes, the anchor is at right angles to the direction of displacement of the plunger 3.

In the embodiment shown, the switch is designed as a single-circuit change-over switch. The leaf spring contact arm 14 is held securely at one end to a fixed plug connection 14*a* in the housing and its free end extends cantilevered in engagement with a first fixed contact 18 in a normally closed or break contact and in connection with an additional end in opposition to a second fixed contact 19 in a normally make contact mode. Each of the contacts 18 and 19 are connected to respective plugs which are identified by the numerals 18*a* and 19*a*.

Figure 2:
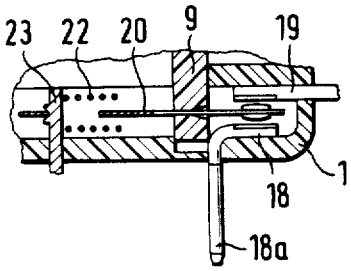
FIG. 2 is a similar side view of part of the switch shown in FIG. 1 illustrating another contact design.
Figure 2A:
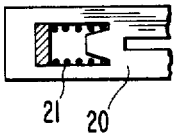
FIG. 2*a* is a plan view of the contact of FIG. 2.

FIGS. 2 and 2*a* are a side view and a partial plan view respectively of another movable contact arm 20. The left end of this contact arm 20 comprises a knife-edge held by a helical spring 22, in a recess 21 form in the contact arm 20, against a fixed contact 23, the latter consisting of a pull-out plug connection to the contact bridge 20 located inside the housing.

The snap on quick-break switch described functions as follows from the initial position shown in FIG. 1: When the activating plunger 3 is depressed, the left arm of the rocker 5 initially loaded by the helical pressure spring 7 is driven counter-clockwise about pivot pin 7, with simultaneous tensioning of the return spring 4, until the right arm of the rocker 5 after travelling in its free path abuts the upper edge of the recess 8 in the slide 9. With the further depression of the activating plunger 3 the helical spring 6 becomes fully compressed. The direct non-positive connection between the activating plunger 3 and the anchor 13 causes the right end of the anchor 13 to lift from the pole shoe 16*b*, only when the left arm of the rocker 5 has traveled the free path in the recess 4 of the activating plunger 3. With the creation of an air gap between the anchor 13 and the lower pole shoe 16*b* and the resultant reduction of the permanent magnetic attractive force acting between these two parts, the force of the tensioned helical pressure spring 6 is now predominant over the combined force of the spring 10 and anchor 13 thus causing the spring 10 to relax and the anchor 13 to accelerate and by way of the rocker 5 causes the slide 9 to move upwardly in the direction of the upper pole shoe 15*b*. With this movement the anchor 13 drives the movable contact 14 upwardly via the movement of the slide 9. The working position is reached when the right end of the anchor 13 abuts on the pole shoe 15*b* and the left end of the anchor 13 abuts on the pole shoe 16*a*. The return to the rest position is accomplished with the respective reversed directions of movement, whereby the helical spring 10 plays the same role as the helical spring 6 before that. Since all springs are arranged in such a way that the respective parts enter into direct operative connection if they break, the switch can also be used as a limit switch such as the VDE (Assoc. of German Engineers) 0113.

I claim:

1. A magnetic snap switch comprising a housing having mounted therein a plunger, a return spring for biasing said plunger, a rocker mounted to pivot about an axis perpendicular to the direction of movement of said plunger and having one end coupled to said plunger, and a magnetic jump mechanism actuated by the movement of the other end of said rocker and coupled to a movable contact arm, a first spring force accumulator arranged at said one end of said rocker effective to move said jump mechanism, a second spring force accumulator arranged at the other end of said rocker effective to return said jump mechanism, said jump mechanism comprising a magnetic member fixed to said housing and having a pair of opposed surfaces, and a magnetic anchor coupled to said contact arm located between said opposed surfaces, said anchor being pivotally mounted about an axis parallel to the axis of said rocker to tilt alternately into abutting rest positions with a respective one of said surfaces, and closing a magnetic circuit therewith in each of its abutting positions, said anchor being coupled to said rocker and actuated in cooperation with said spring force accumulators to jump from one surface to the other on movement of said rocker sufficient to create an air gap between said anchor and the existing abutting surface.

2. The snap switch according to claim 1 wherein said one end of said rocker is freely seated in a recess formed in said plunger said recess permitting movement of said one end over a predetermined length, and said first spring force accumulator comprises a helical spring mounted in said plunger and bearing on said one end in the direction of activation of said plunger, and said return spring abuts said plunger in opposition thereto.

3. The snap switch according to claim 2 wherein said other end of rocker is freely seated in a recess in an intermediate member bearing on said anchor, and said second spring force accumulator comprises a helical spring mounted in said intermediate bearing against the second end of said rocker arm in a direction opposite that a plunger activation.

4. The snap switch according to claim 3 including a coupling between said jump mechanism and said contact arm comprising a slide mounted within said housing coupled at one end to said rocker, at the other end to said contact arm, and midway to said anchor.

5. The snap switch according to claim 4 wherein said coupling and said intermediate member are integral.

6. The snap switch according to claim 5 wherein said contact arm is removably secured to said coupling.

7. The snap switch according to claim 6 wherein said contact arm is a resilient bridge, one end of which is formed as a contact and rests constantly on a fixed contact, the other end of which is formed to make selected contact with the second fixed contact as a break, make, or change over contact.

8. The snap switch according to claim 5 wherein said contact arm is a cantilevered leaf spring.

9. A magnetic snap switch comprising a housing having mounted therein a plunger, a return spring for biasing said plunger, a rocker mounted to pivot about an axis perpendicular to the direction of movement of said plunger having one end coupled to said plunger, and a magnetic jump mechanism actuated by the movement of the other end of said rocker and coupled to a movable contact arm, a first spring force accumulator arranged at said one end of said rocker effective to move said jump mechanism, a second spring force accumulator arranged at the other end of said rocker effective to return said jump mechanism, said jump mechanism comprising a pair of C-shaped yokes aligned in a direction parallel to said rocker and having ends forming pole shoes, and a permanent magnet arranged therebetween, a ferromagnetic rod anchor extending the length of said yokes and being pivotable about an axis parallel to the axis about which said rocker pivots from a first position in abutment with one pole shoe of each of said opposed yokes closing a magnetic circuit therewith, and a second position in abutment with the other pole shoe of the opposed yokes closing a magnetic circuit therewith said anchor being coupled to said rocker and actuated in cooperation with said spring force accumulators to jump from one surface to the other on movement of said rocker sufficient to create an air gap between said anchor and the existing abutting surface.

10. The snap switch according to claim 9 wherein said anchor is mounted to pivot eccentrically of its ends.

11. The snap switch according to claim 10 wherein said C-shaped yokes are mounted closer to each other at one end than at the other end and said anchor is pivotally mounted therebetween to move between the ends spaced further apart.

12. The snap switch according to claim 11 wherein the longitudinal axis of said anchor extends along the center line between the first and second positions of abutment with the pole shoes, perpendicular to the direction of said plunger.

* * * * *